US006986617B1

(12) United States Patent
Denker

(10) Patent No.: US 6,986,617 B1
(45) Date of Patent: Jan. 17, 2006

(54) TELESCOPIC LOTION APPLICATOR

(76) Inventor: William C. Denker, 3C Reggie Way, Broad Brook, CT (US) 06016

( * ) Notice: Subject to any disclaimer, the term of this patent is extended or adjusted under 35 U.S.C. 154(b) by 0 days.

(21) Appl. No.: 11/110,483

(22) Filed: Apr. 21, 2005

(51) Int. Cl.
*A46B 5/02* (2006.01)
*A46B 11/00* (2006.01)

(52) U.S. Cl. ..... 401/6; 401/122; 401/130; 401/118

(58) Field of Classification Search ..... 401/6, 401/121, 122, 126, 130, 118
See application file for complete search history.

(56) References Cited

U.S. PATENT DOCUMENTS

| | | | | |
|---|---|---|---|---|
| 1,962,875 | A * | 6/1934 | Reber | 401/130 |
| 2,034,416 | A * | 3/1936 | Peat | 401/126 |
| 3,226,754 | A * | 1/1966 | Brittain | 401/130 |
| 3,363,635 | A * | 1/1968 | Wurmbock | 401/122 |
| 3,951,157 | A * | 4/1976 | Idec | 401/122 |
| 4,128,350 | A | 12/1978 | Gamache | |
| 4,276,719 | A * | 7/1981 | Keeton et al. | 401/126 |
| 4,869,612 | A * | 9/1989 | Mooney et al. | 401/130 |
| 5,810,027 | A * | 9/1998 | Frantzeskakis | 401/208 |
| 5,851,077 | A | 12/1998 | Trejo | |
| 6,017,162 | A | 1/2000 | Call | |
| 6,196,743 | B1 * | 3/2001 | Brucker | 401/6 |
| 2004/0018037 | A1 * | 1/2004 | Gueret | 401/126 |

OTHER PUBLICATIONS

Title of Source: 2003 Improvement Mail Order Catalog Product Name: Long-Reach Lotion Applicator.
Title of Source: www.solutionscatalog.com Product Name: Body Cream Applicator/Massager.
Title of Source: www.ihcatalog.com Product Name: Body Creamer.
Title of Source: www.gaiam.com Product Name: Body Lotion Extender.

* cited by examiner

*Primary Examiner*—Khoa D. Huynh

(57) ABSTRACT

An apparatus includes a cylindrically shaped reservoir for housing lotion therein. The reservoir has a continuous outer surface defining monolithically formed upper and lower portions. The upper portion is spaced inwardly from the lower portion. A cap is threadably conjoinable with the upper portion. An elongated and rectilinear handle is slidably positional into the reservoir. The handle is provided with a monolithically formed bottom lip portion annularly protruding away therefrom and a monolithically formed top end that has a spherical shape. An applicator pad is rotatably conjoined about the handle and nested within the reservoir in such a manner that the applicator pad becomes impregnated with the lotion during non-operating conditions. The applicator pad has an open top end portion wherein the handle is positioned therethrough. The applicator pad maintains a static relationship with the reservoir as the handle is linearly extracted from the reservoir.

5 Claims, 5 Drawing Sheets

TELESCOPIC LOTION APPLICATOR

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to lotion applicators and, more particularly, to a telescopic lotion applicator for applying lotion onto hard-to-reach human body parts.

2. Prior Art

People are often required to apply lotions for protective or medicinal reasons to areas of their bodies that are hard to reach by the individual themselves. Examples include applying sunscreen or muscle relaxing ointment to one's back. For elderly individuals, the application of lotion to their legs, especially the back of their leg, is also troublesome since they have difficulty bending down to reach those areas. The result is that people either neglect to properly apply lotions etc. to those areas, or they require the assistance of another individual to help them. A proposed solution is the use of an applicator to apply the lotion without the help of another person.

The use of lotion applicators is well known in the prior art. More specifically, lotion applicators heretofore devised and utilized are known to consist basically of familiar, expected and obvious structural configurations, notwithstanding the myriad of designs encompassed by the crowded prior art which have been developed for the fulfillment of countless objectives and requirements.

Although such lotion applicators are effective in their applications, they still have many shortcomings. One disadvantage is the fixed length of most applicator's handle. This limits the reach of the applicator and still prevents certain areas form being properly and evenly covered. Another existing problem with conventional applicators is that once the applicator is removed from its container, there is no means to remove excess lotion etc. thereon. This leaves the user with the option of over applying the product or having to wipe off the excess lotion with their hands or a paper towel, which can be very messy and inconvenient.

Spray nozzle applicators are also inconvenient since a person is still required to use their hands if they wish to evenly spread the lotion that has been applied to their skin. This is especially true when using such applicators for sunscreen application. Applicators that incorporate a roller attached to the dispensing bottle, such as those seen in some deodorant dispensers, may eliminate the need to use one's hands, but still do not allow an individual to apply the lotion in hard to reach places.

Accordingly, a need remains for a telescopic lotion applicator in order to overcome the above-noted shortcomings. The present invention satisfies such a need by providing a telescopic lotion applicator that is easy and convenient to use, light weight and durable in design, and inexpensive to produce. Such a lotion applicator eliminates the need to ask for assistance when applying lotion to one's back, and further reduces the mess and greasy feeling associated with applying lotion by hand. Advantageously, the telescopic lotion applicator is versatile, in that it can be employed to apply a wide array of products such as sunscreen, oils, moisturizing lotions, medicinal rubs, etc.

BRIEF SUMMARY OF THE INVENTION

In view of the foregoing background, it is therefore an object of the present invention to provide a telescopic lotion applicator. These and other objects, features, and advantages of the invention are provided by a hand-operable apparatus for applying lotion onto hard-to-reach human body parts.

The apparatus includes a cylindrical shaped reservoir conveniently housing a predetermined quantity of lotion therein. Such a reservoir has a continuous outer surface extending along a longitudinal length thereof and defines monolithically formed upper and lower portions. The reservoir further has a centrally registered longitudinal axis passing therethrough wherein the lower portion of the outer surface is equidistantly spaced therefrom. The upper portion of the outer surface is spaced inwardly from the lower portion.

Such an upper portion preferably includes a monolithically formed finger portion protruding inwardly towards the longitudinal axis and equidistantly spaced therefrom. The finger portion continues along an inner surface of the upper portion and partially intersects a travel path of the applicator pad so that the finger portion effectively rubs against the applicator pad and advantageously removes excess lotion as the applicator pad is being extracted from the reservoir.

The reservoir further includes a cap threadably conjoinable with the upper portion of the reservoir for advantageously preventing undesirable foreign elements from contaminating the lotion. Such a cap may be provided with a centrally registered opening sized and shaped for receiving the handle therethrough. The cap opening is vertically registered with the open top end portion of the applicator pad such that the handle can conveniently be freely biased along the longitudinal axis.

An elongated and rectilinear handle is slidably positional into the reservoir in such a manner that the handle can conveniently be completely extracted and separated from the reservoir during operating conditions. Such a handle is directly and permanently attached to the cap such that the cap is extracted in sync with the handle when the handle is withdrawn from the reservoir. The handle is provided with a monolithically formed bottom lip portion annularly protruding away from an outer surface of the handle. Such a bottom lip portion of the handle is nested directly on a bottom surface of the applicator pad when the cap is conjoined to the reservoir. The handle further includes a monolithically formed top end that has a spherical shape.

An applicator pad formed from fluid-absorbing material is rotatably conjoined about the handle and nested within the reservoir in such a manner that the applicator pad effectively becomes impregnated with the lotion during non-operating conditions. Such an applicator pad has an open top end portion wherein the handle is positioned therethrough. The applicator pad maintains a static relationship with the reservoir as the handle is linearly extracted from the reservoir until the bottom lip portion of the handle engages the open top end portion of the applicator pad at which time the applicator pad is extracted from the reservoir.

An outer surface of the applicator pad is preferably spaced from an interior surface of the reservoir so that the lotion can advantageously effectively permeate an entire length of the applicator pad. Such an applicator pad may be provided with an axial bore sized and shaped for housing the bottom lip portion. The handle is slidably positional along the axial bore while the applicator pad remains fixed at a static position.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
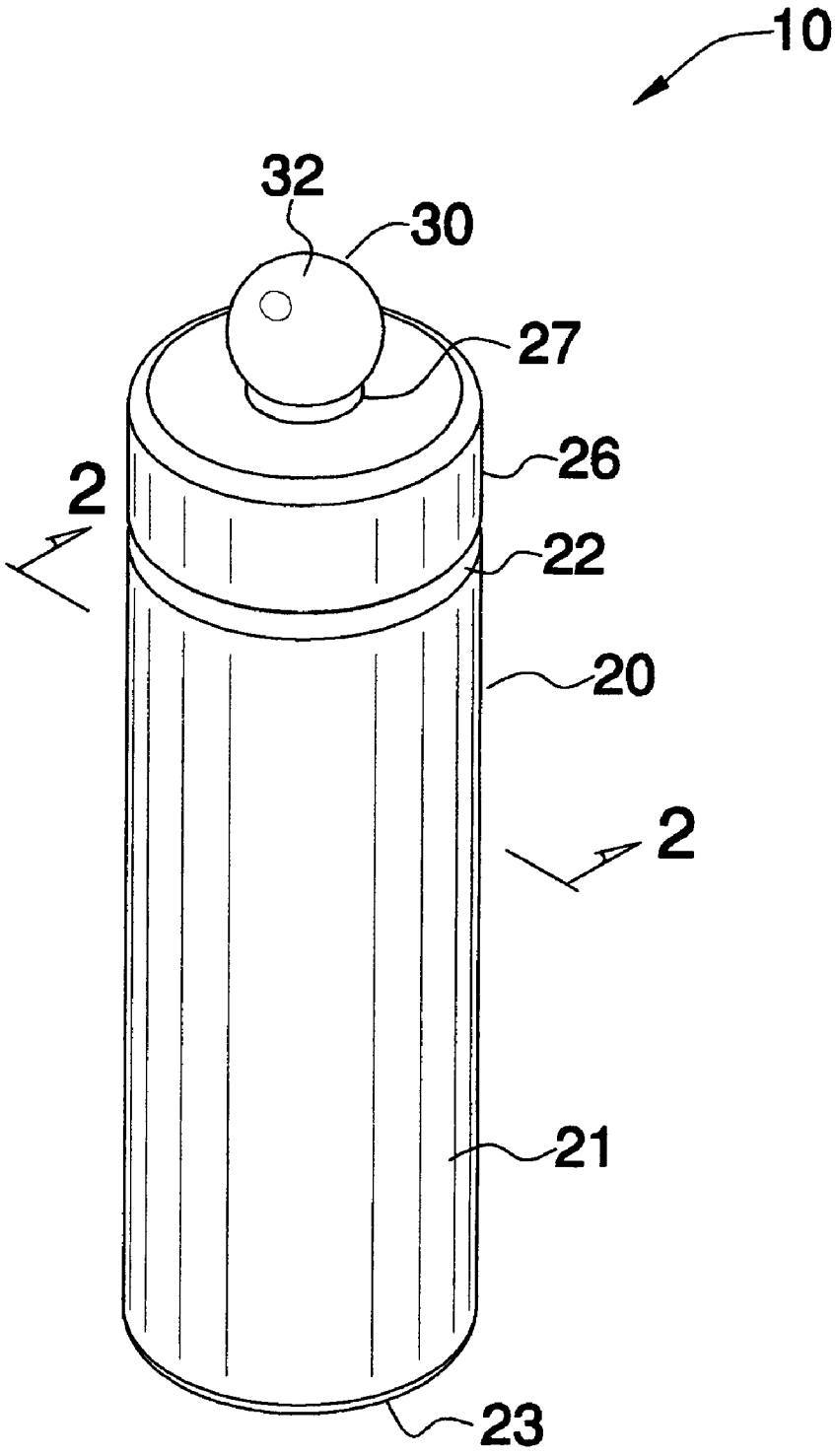
FIG. 1 is a perspective view showing a telescopic lotion applicator, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1–5 by the reference numeral 10 and is intended to provide a telescopic lotion applicator. It should be understood that the apparatus 10 may be used to apply many different types of substances and should not be limited in use to only applying lotions.

Referring initially to FIG. 1, the apparatus 10 includes a cylindrical shaped reservoir 20 conveniently housing a predetermined quantity of lotion 11 therein. Of course, the reservoir 20 may be produced in a variety of different shapes, sizes and colors, and may include surface indicia on an outer surface 21 thereof for conveniently indicating the type of lotion 11 held therein, as is obvious to a person of ordinary skill in the art. The reservoir 20 may obviously also be used to store substances other than lotions, such a ointments, medical creams, sun screen, etc., as is obvious to a person of ordinary skill in the art. Such a reservoir 20 has a continuous outer surface 21 extending along a longitudinal length thereof and defines monolithically formed upper 22 and lower 23 portions.

Referring to FIGS. 1, 2, 3 and 5, the reservoir 20 further has a centrally registered longitudinal axis A passing therethrough wherein the lower portion 23 of the outer surface 21 is equidistantly spaced therefrom. The upper portion 22 of the outer surface 21 is spaced inwardly from the lower portion 23. Such an upper portion 22 includes a monolithically formed finger portion 24 protruding inwardly towards the longitudinal axis and equidistantly spaced therefrom. The finger portion 24 continues along an inner surface 25 of the upper portion 22 and partially intersects a travel path of the applicator pad 40 (described herein below) so that the finger portion 24 effectively rubs against the applicator pad 40 and advantageously removes excess lotion 11 as the applicator pad 40 is being extracted from the reservoir 20. Such a finger portion 24 is thus important and advantageous for preventing excess lotion 11 from dripping off of the applicator pad 40 and subsequently creating a mess.

Referring to FIGS. 1 through 5, the reservoir 20 further includes a cap 26 threadably conjoinable with the upper portion 22 of the reservoir 20 for advantageously preventing undesirable foreign elements from contaminating the lotion 11. Furthermore, the cap 26 is essential for preventing the lotion 11 from drying out and becoming spoiled for application purposes, thus saving the user a considerable amount of money. Such a cap 20 is provided with a centrally registered opening 27 sized and shaped for receiving the handle 30 (described herein below) therethrough. The cap opening 27 is vertically registered with the open top end portion 41 (described herein below) of the applicator pad 40 such that the handle 30 can conveniently be freely biased along the longitudinal axis.

Still referring to FIGS. 1 through 5, an elongated and rectilinear handle 30 is slidably positional into the reservoir 20 in such a manner that the handle 30 can conveniently be completely extracted and separated from the reservoir 20 during operating conditions. Such a handle 30 is directly and permanently attached to the cap 26 such that the cap 26 is extracted in sync with the handle 30 when the handle 30 is withdrawn from the reservoir 20. The handle 30 is provided with a monolithically formed bottom lip portion 31 annularly protruding away from an outer surface of the handle 30. Such a bottom lip portion 31 of the handle 30 is nested directly on a bottom surface 44 of the applicator pad 40 when the cap 26 is conjoined to the reservoir 20. The handle 30 further includes a monolithically formed top end 32 that has a spherical shape. Such a spherical top end 32 is essential for allowing a user to conveniently grasp and manipulate the handle 30 without getting lotion 11 on their hands.

Figure 2:
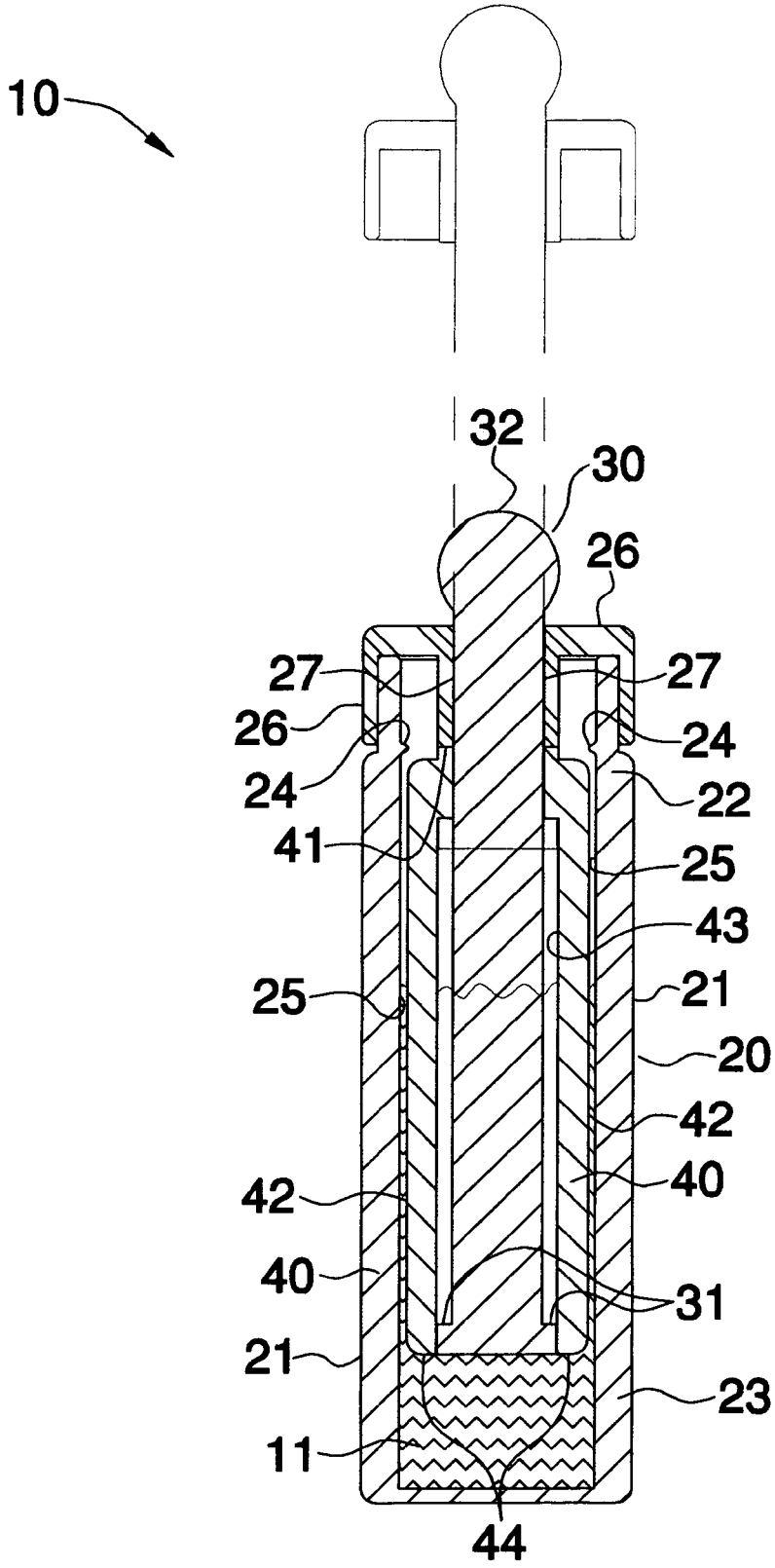
FIG. 2 is a cross-sectional view of the apparatus shown in FIG. 1, taken along line 2—2.
Figure 3:
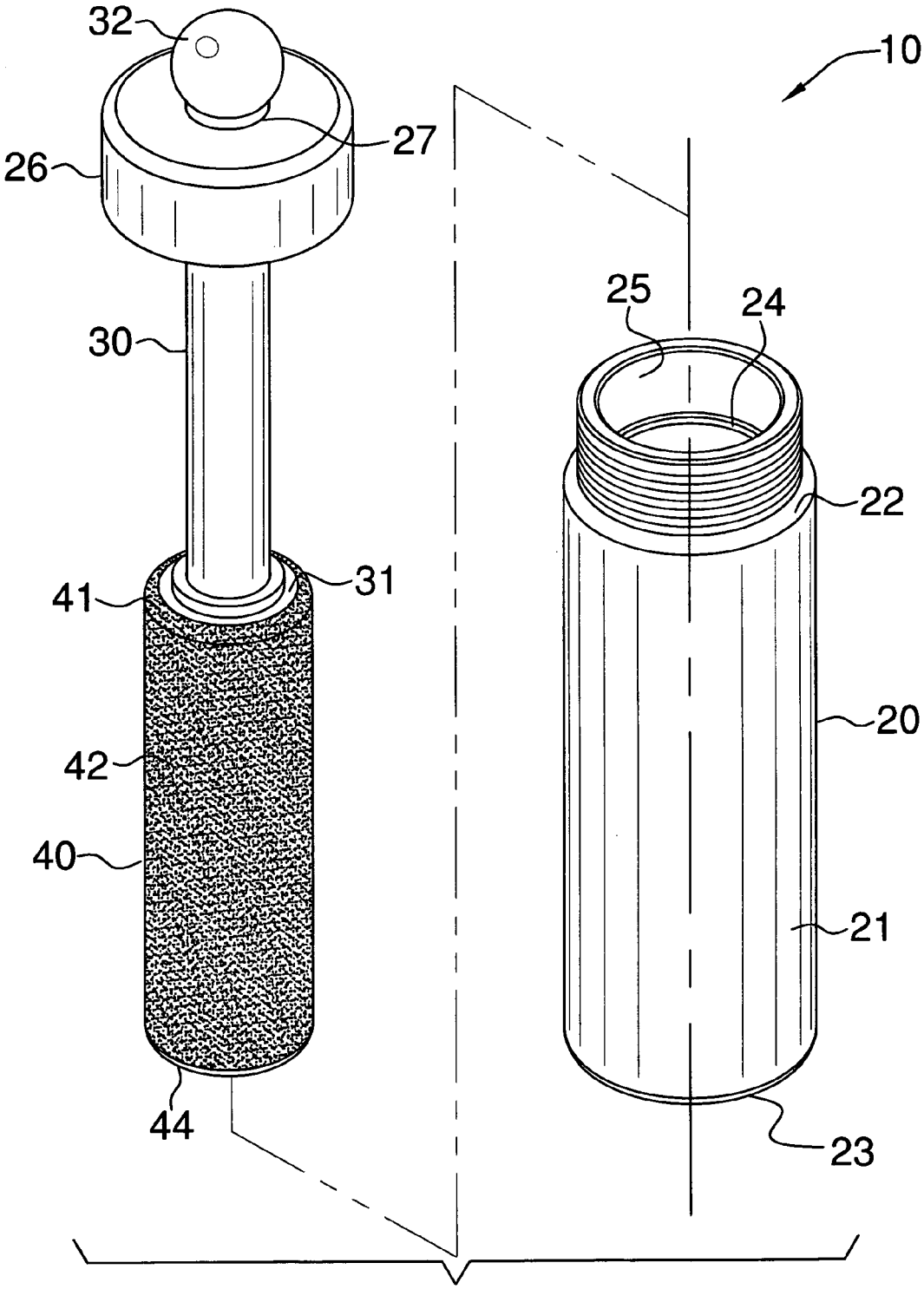
FIG. 3 is a perspective view of the apparatus shown in FIG. 1, showing the handle and applicator pad completely removed from the reservoir.
Figure 4:
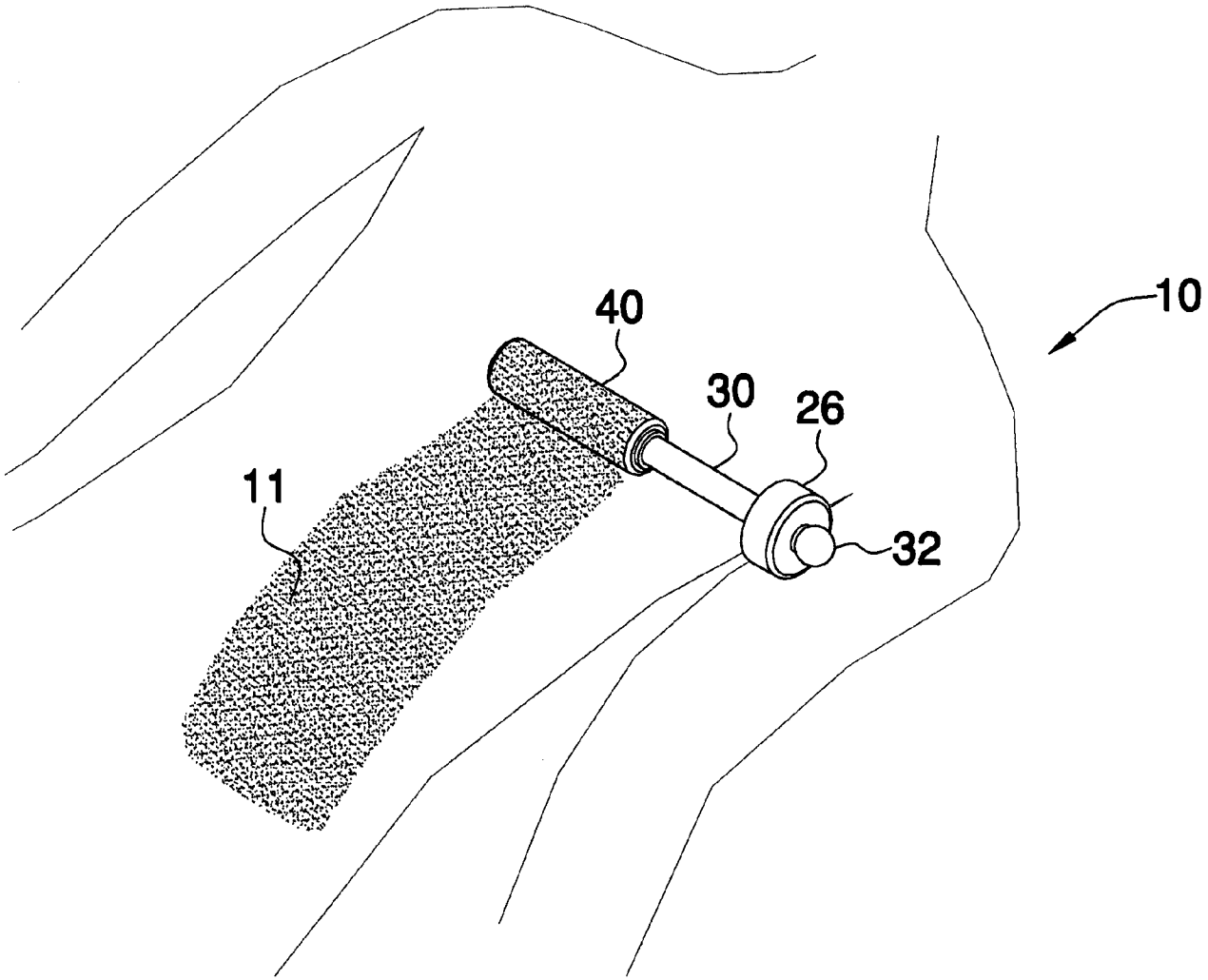
FIG. 4 is an elevated perspective view showing the apparatus shown in FIG. 1 during operating conditions.
Figure 5:
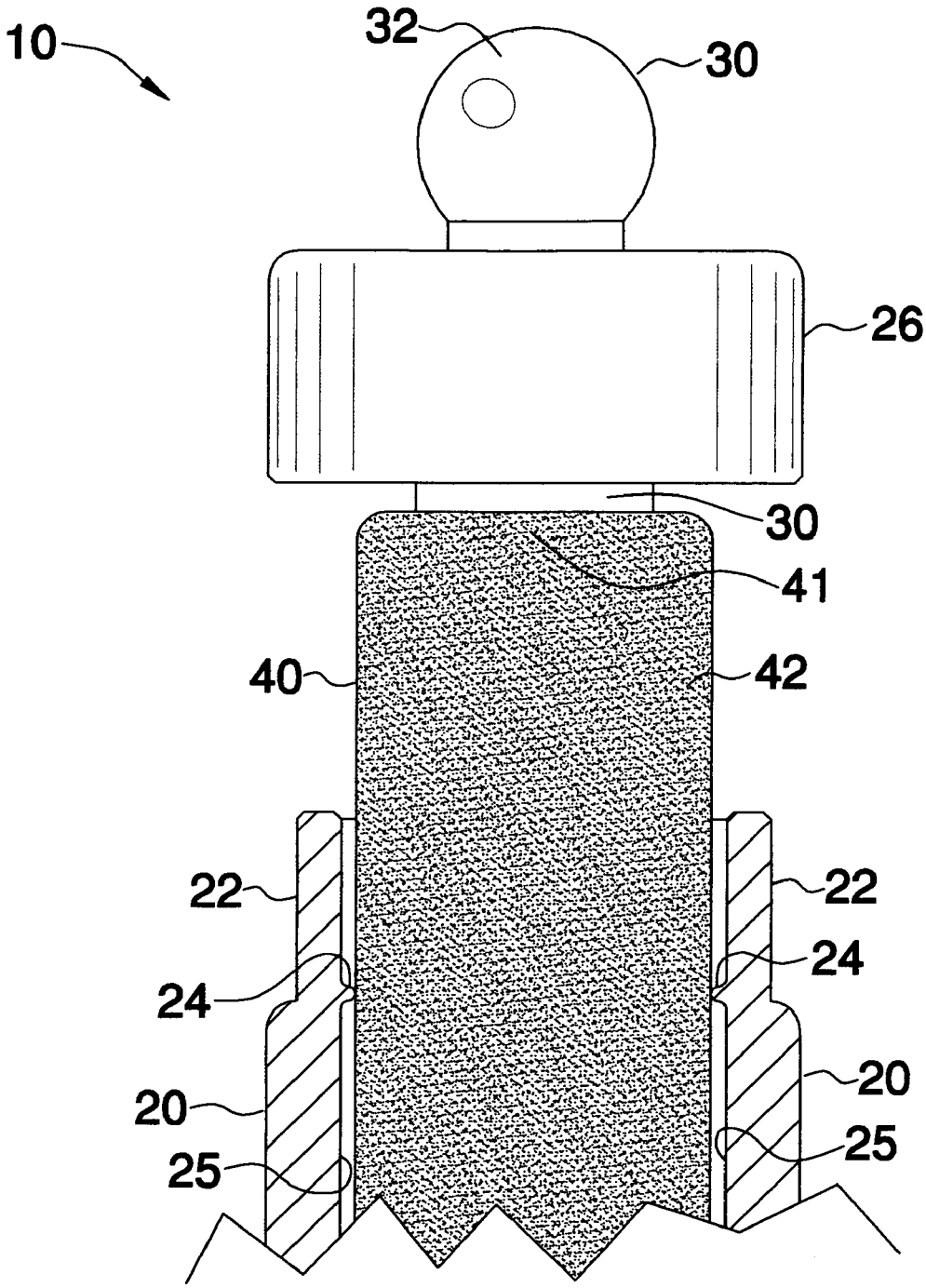
FIG. 5 is an enlarged cross-sectional view of the apparatus shown in FIG. 2, showing the reservoir finger portion engaged with the applicator pad for removing excess lotion as the handle is extracted.

Referring to FIGS. 2 though 5, an applicator pad 40 formed from fluid-absorbing material is rotatably conjoined about the handle 30 and nested within the reservoir 20 in such a manner that the applicator pad 40 effectively becomes impregnated with the lotion 11 during non-operating conditions. Such an applicator pad 40 has an open top end portion 41 wherein the handle 30 is positioned therethrough. The applicator pad 40 maintains a static relationship with the reservoir 20 as the handle 30 is linearly extracted from the reservoir 20 until the bottom lip portion 31 of the handle 30 engages the open top end portion 41 of the applicator pad 40, at which time the applicator pad 40 is extracted from the reservoir 20. An outer surface 42 of the applicator pad 40 is spaced from an interior surface 25 of the reservoir 20 so that the lotion 11 can advantageously effectively permeate an entire length of the applicator pad 40, thus ensuring that the lotion 11 is evenly applied to the user's skin. Such an applicator pad 40 is provided with an axial bore 43 sized and shaped for housing the bottom lip portion 31. The bore 43 is crucial to the apparatus 10 for allowing the handle 30 to telescopically engage the applicator pad 40 and thus effectively extend and adjust a length of the handle 30. The handle 30 is slidably positional along the axial bore 43 while the applicator pad 40 remains fixed at a static position.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A hand-operable apparatus for applying lotion onto hard-to-reach human body pads, said apparatus comprising:

a cylindrical shaped reservoir housing a predetermined quantity of lotion therein, said reservoir having a continuous outer surface extending along a longitudinal length thereof and defining monolithically formed upper and lower portions, said reservoir further having a centrally registered longitudinal axis passing therethrough wherein said lower portion of said outer surface is equidistantly spaced therefrom and said upper portion of said outer surface is spaced inwardly from said lower portion, said reservoir further including a cap threadably conjoinable with said upper portion of said reservoir for preventing undesirable foreign elements from contaminating the lotion, said cap having a centrally registered through opening, said cap opening having an upper surface and an opposite lower surface;

an elongated and rectilinear handle slidably positional into said reservoir in such a manner that said handle completely extracted and separated from said reservoir during operating conditions, said handle being directly and permanently attached to said cap such that said cap is extracted in sync with said handle when said handle is withdrawn from said reservoir, said handle being provided with a monolithically formed bottom lip portion annularly protruding away from an outer surface of said handle, said handle includes a monolithically formed top end extending through said cap opening and located above and beyond said upper surface of said cap opening; and an applicator pad formed from fluid-absorbing material rotatably conjoined around said handle continuous outer surface and nested within said reservoir in such a manner that said applicator pad becomes impregnated with the lotion during non-operating conditions, said applicator pad having a bottom surface, said applicator pad having an open top end portion wherein said handle is positioned therethrough, said open top end portion of said applicator pad contacting said lower surface of said cap opening when said handle is positioned therethrough;

wherein said bottom lip portion of said handle is nested directly on said bottom surface of said applicator pad when said cap is conjoined to said reservoir in such a way that said bottom lip portion of said handle is flush with said bottom surface of said applicator pad when said handle is positioned therethrough;

wherein said applicator pad maintains a static relationship with said reservoir as said handle is linearly extracted from said reservoir until said bottom lip portion of said handle engages said open top end portion of said applicator pad at which time said applicator pad is extracted from said reservoir.

2. The apparatus of claim 1, wherein said a centrally registered opening sized and shaped for receiving said handle therethrough, said cap opening being vertically registered with said open top end portion of said applicator pad such that said handle can freely biased along the longitudinal axis.

3. The apparatus of claim 1, said upper portion of said reservoir comprising: a monolithically formed finger portion protruding inwardly towards the longitudinal axis and equidistantly spaced therefrom, said finger portion continuing along an inner surface of said upper portion and partially intersecting a travel path of said applicator pad so that said finger portion rubs against said applicator pad and removes excess lotion as said applicator pad is being extracted from said reservoir.

4. The apparatus of claim 1, wherein an outer surface of said applicator pad is spaced from an interior surface of said reservoir so that the lotion can effectively permeate an entire length of said applicator pad.

5. The apparatus of claim 1, wherein said applicator pad is provided with an axial bore sized and shaped for housing said bottom lip portion, said handle being slidably positional along the axial bore while said applicator pad remains fixed at a static position.

* * * * *